US009453410B2

(12) United States Patent
Logan et al.

(10) Patent No.: US 9,453,410 B2
(45) Date of Patent: Sep. 27, 2016

(54) MUD HAMMER

(71) Applicant: EVOLUTION ENGINEERING INC., Calgary (CA)

(72) Inventors: Aaron W. Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 14/900,069

(22) PCT Filed: Jun. 20, 2014

(86) PCT No.: PCT/CA2014/050591

§ 371 (c)(1),
(2) Date: Dec. 18, 2015

(87) PCT Pub. No.: WO2014/201573

PCT Pub. Date: Dec. 24, 2014

(65) Prior Publication Data

US 2016/0138391 A1 May 19, 2016

Related U.S. Application Data

(60) Provisional application No. 61/838,199, filed on Jun. 21, 2013.

(51) Int. Cl.

| | |
|---|---|
| ***E21B 47/16*** | (2006.01) |
| ***E21B 47/18*** | (2012.01) |
| ***E21B 4/14*** | (2006.01) |
| ***E21B 41/00*** | (2006.01) |
| ***E21B 47/12*** | (2012.01) |

(52) U.S. Cl.

CPC ..... *E21B 47/18* (2013.01); *E21B 4/14* (2013.01); *E21B 41/0085* (2013.01); *E21B 47/122* (2013.01); *E21B 47/187* (2013.01)

(58) Field of Classification Search

CPC .. E21B 41/0085; E21B 47/122; E21B 47/18; E21B 4/14

See application file for complete search history.

(56) References Cited

U.S. PATENT DOCUMENTS

| | | | |
|---|---|---|---|
| 4,628,495 | A | 12/1986 | Peppers et al. |
| 4,675,852 | A | 6/1987 | Russell et al. |
| 4,742,498 | A | 5/1988 | Barron |
| 4,825,421 | A | 4/1989 | Jeter |
| 4,914,637 | A | 4/1990 | Goodsman |
| 5,117,398 | A | 5/1992 | Jeter |

(Continued)

FOREIGN PATENT DOCUMENTS

| | | | |
|---|---|---|---|
| EP | 0080224 | B1 | 12/1987 |
| EP | 0467642 | A2 | 1/1992 |

(Continued)

*Primary Examiner* — Omeed Alizada

(74) *Attorney, Agent, or Firm* — Oyen Wiggs Green & Mutala LLP

(57) ABSTRACT

A mud hammer is driven by the flow of drilling fluid to generate pressure pulses. Timing and/or amplitude of the pulses are altered to encode data by applying electromagnetic forces to a movable member of the mud hammer. In an example embodiment the movable member carries one or more magnets and electromagnetic forces are applied to the movable member by one or more electromagnets. The mud hammer may also generate electrical power that may be applied to charge batteries and/or drive downhole electrical apparatus.

55 Claims, 9 Drawing Sheets

(56) References Cited

U.S. PATENT DOCUMENTS

| | | | |
|---|---|---|---|
| 5,396,965 | A | 3/1995 | Hall et al. |
| 5,586,084 | A | 12/1996 | Barron et al. |
| 6,002,643 | A | 12/1999 | Tchakarov et al. |
| 6,016,288 | A | 1/2000 | Frith |
| 6,053,261 | A | 4/2000 | Walter |
| 6,367,565 | B1 | 4/2002 | Hall |
| 6,484,817 | B2 | 11/2002 | Innes |
| 6,536,519 | B1 | 3/2003 | Vaynshteyn et al. |
| 6,588,518 | B2 | 7/2003 | Eddison |
| 6,626,253 | B2 | 9/2003 | Hahn et al. |
| 6,714,138 | B1 | 3/2004 | Turner et al. |
| 6,752,222 | B2 | 6/2004 | Karasawa et al. |
| 6,757,218 | B2 | 6/2004 | Dubinsky |
| 6,898,150 | B2 | 5/2005 | Hahn et al. |
| 6,910,542 | B1 | 6/2005 | Walter |
| 6,975,244 | B2 | 12/2005 | Hahn et al. |
| 7,011,156 | B2 | 3/2006 | von Gynz-Rekowski |
| 7,139,219 | B2 | 11/2006 | Kolle et al. |
| 7,145,834 | B1 | 12/2006 | Jeter |
| 7,180,826 | B2 | 2/2007 | Kusko et al. |
| 7,313,481 | B2 | 12/2007 | Moos et al. |
| 7,327,634 | B2 | 2/2008 | Perry et al. |
| 7,330,397 | B2 | 2/2008 | Ganesan et al. |
| 7,382,686 | B2 | 6/2008 | Innes |
| 7,392,857 | B1 | 7/2008 | Hall et al. |
| 7,397,388 | B2 | 7/2008 | Huang et al. |
| 7,417,920 | B2 | 8/2008 | Hahn et al. |
| 7,423,932 | B1 | 9/2008 | Jeter |
| 7,564,741 | B2 | 7/2009 | Pratt et al. |
| 7,617,886 | B2 | 11/2009 | Hall |
| 7,646,310 | B2 | 1/2010 | Close |
| 7,719,439 | B2 | 5/2010 | Pratt et al. |
| 7,808,859 | B2 | 10/2010 | Hahn et al. |
| 7,836,948 | B2 | 11/2010 | Kusko et al. |
| 7,881,155 | B2 | 2/2011 | Close |
| 7,958,952 | B2 | 6/2011 | Kusko et al. |
| 8,138,943 | B2 | 3/2012 | Kusko et al. |
| 8,174,404 | B2 | 5/2012 | Hahn et al. |
| 8,203,908 | B2 | 6/2012 | Pratt et al. |
| 8,467,268 | B2 | 6/2013 | Close |
| 8,517,093 | B1 | 8/2013 | Benson |
| 8,678,107 | B2 | 3/2014 | Benson |
| 2002/0159333 | A1 | 10/2002 | Hahn et al. |
| 2003/0051881 | A1 | 3/2003 | Vinegar et al. |
| 2006/0118334 | A1 | 6/2006 | Hahn et al. |
| 2008/0156536 | A1 | 7/2008 | Hall et al. |
| 2010/0065330 | A1 | 3/2010 | Walter |
| 2010/0157735 | A1 | 6/2010 | Allan et al. |
| 2010/0212963 | A1 | 8/2010 | Gopalan et al. |
| 2011/0169655 | A1 | 7/2011 | Close et al. |
| 2013/0206401 | A1 | 8/2013 | Bhoite et al. |
| 2013/0340999 | A1 | 12/2013 | Benson |
| 2014/0110172 | A1 | 4/2014 | Benson |

FOREIGN PATENT DOCUMENTS

| | | | |
|---|---|---|---|
| EP | 1354127 | B1 | 12/2005 |
| EP | 1941124 | B1 | 4/2014 |
| GB | 2009473 | A | 6/1979 |
| GB | 2096372 | A | 10/1982 |
| GB | 2120431 | A | 11/1983 |
| GB | 2360800 | A | 10/2001 |
| GB | 2386390 | B | 3/2005 |
| GB | 2407598 | B | 6/2005 |
| GB | 2430686 | A | 4/2007 |
| GB | 2489628 | B | 2/2013 |
| WO | 0165061 | A1 | 9/2001 |
| WO | 0229441 | A1 | 4/2002 |
| WO | 2002055837 | A1 | 7/2002 |
| WO | 02059459 | A1 | 8/2002 |
| WO | 02068797 | A2 | 9/2002 |
| WO | 02072993 | A2 | 9/2002 |
| WO | 2006127760 | A1 | 11/2006 |
| WO | 2007036722 | A1 | 4/2007 |
| WO | 2008014039 | A2 | 1/2008 |
| WO | 2008092256 | A1 | 8/2008 |
| WO | 2011084939 | A2 | 7/2011 |
| WO | 2012094242 | A2 | 7/2012 |
| WO | 2012138383 | A2 | 10/2012 |
| WO | 2013122987 | A1 | 8/2013 |
| WO | 2013170075 | A2 | 11/2013 |

MUD HAMMER

CROSS-REFERENCE TO RELATED APPLICATION

This application claims priority from U.S. Application No. 61/838,199 filed 21 Jun. 2013. For purposes of the United States, this application claims the benefit under 35 U.S.C. §119 of U.S. Application No. 61/838,199 filed 21 Jun. 2013 and entitled MUD HAMMER which is hereby incorporated herein by reference for all purposes.

TECHNICAL FIELD

This application relates to mud hammers. Embodiments provide multi-functional mud hammers suitable for operation to generate pressure pulses to assist in drilling and to operate as mud pulse telemetry pulser tools and/or downhole power generators.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; and the like. The BHA is typically advanced into the wellbore by a string of metallic tubulars (drill pipe).

A bottom hole assembly may also include a mud hammer. A mud hammer acts to disrupt the flow of drilling fluid through the drill string to create a "pulsed" flow of drilling fluid. The pulses are delivered through the drill bit and help to dislodge and clear away drill cuttings from the drill bit. This may increase the drilling penetration rate.

A mud hammer typically comprises a piston and a port or orifice. The piston is biased away from the orifice by a bias force provided by a spring or other mechanism. A flow of drilling fluid drives the piston in an axial direction to restrict drilling fluid flow through the port. The bias force then moves the piston to a position where flow through the port can resume. The flow of drilling fluid thereby drives a self-starting oscillation of the piston, thereby alternatively allowing and restricting the flow of drilling fluid through the port. The mud hammer is configured so that during normal drilling operations, the opposing forces of the spring and the flow of drilling fluid result in the piston oscillating against the orifice, thereby generating periodic pulses in the flow of drilling fluid.

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

Downhole electronics are typically powered by a downhole battery. The capacity of the downhole battery may limit the nature and the duration of the electronics operations that are performed downhole.

There are several known telemetry techniques. These include transmitting information by generating vibrations in drilling fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

A mud pulser may be used to perform MP telemetry. A mud pulser typically comprises an electrically-controlled valve which can be opened and closed in a coded pattern to create pressure waves in drilling fluid within a drill string. These pressure waves may be detected by a detector (e.g. a pressure transducer) at the surface. The intensity and the frequency of the pressure waves may be used to encode data to be transmitted to the surface.

Examples of mud pulsers are rotating disc valve mud pulsers and poppet valve mud pulsers. In a rotating disc valve mud pulser, a motor rotates a restrictor relative to a fixed housing to either allow or restrict the flow of drilling fluid through the housing. In a poppet valve mud pulser, a valve is move axially against an orifice to permit or restrict the flow of drilling fluid through the orifice.

The inventors have recognized that there remains a need for effective alternative means for generating controlled pressure pulses in drilling fluid for MP telemetry, for generating pressure pulses in drilling fluid to dislodge and clear away drill cuttings from a drill bit, and for generating electricity to power downhole electronics.

SUMMARY

This invention has a number of aspects. These aspects include methods for mud pulse telemetry and mud hammer apparatus.

One non-limiting aspect of the invention provides a mud hammer comprising a hammer movable relative to a port to generate drilling fluid pulses within a bore of a drill string. A magnet is coupled to the hammer. A coil is located near the hammer. A power source is connected to energize the coil to generate a variable magnetic field at the magnet. The power source comprises a control circuit configured to receive a signal encoding data; and the control circuit is configured to control the variable current through the wire coil to alter motion of the hammer to generate drilling fluid pulses encoding the data.

Another non-limiting aspect of the invention provides a mud pulse telemetry method. The method comprises operating a downhole pulser in a drill string to generate pressure pulses by flowing drilling fluid through the drill string. The flowing drilling fluid causing oscillating motion of a movable member of the pulser. The method comprises altering motion of the movable member by applying electromagnetic forces to the movable member to alter one or both of the intensity and timing of the pressure pulses according to telemetry data. The telemetry data may be recovered by detecting the pulses at a location remote from the pulser (e.g. at the surface), detecting variations in intensity and/or frequency of the pulses and decoding the data.

Another non-limiting aspect provides a method for operating a mud hammer. The method comprises providing a hammer for generating drilling fluid pulses within a bore of a drill string, at least one magnet coupled to the hammer, an electromagnet located to generate a variable magnetic field at the magnet and a power source connected to drive the electromagnet. The method drives motion of the hammer under the combined influence of a flow of drilling fluid through the bore and the variable magnetic field to generate pulses in the drilling fluid, the pulses encoding data. In some embodiments the data is encoded (at least in part) in the frequency of the pulses. In some embodiments the data is encoded (at least in part) in the amplitude of the pulses.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
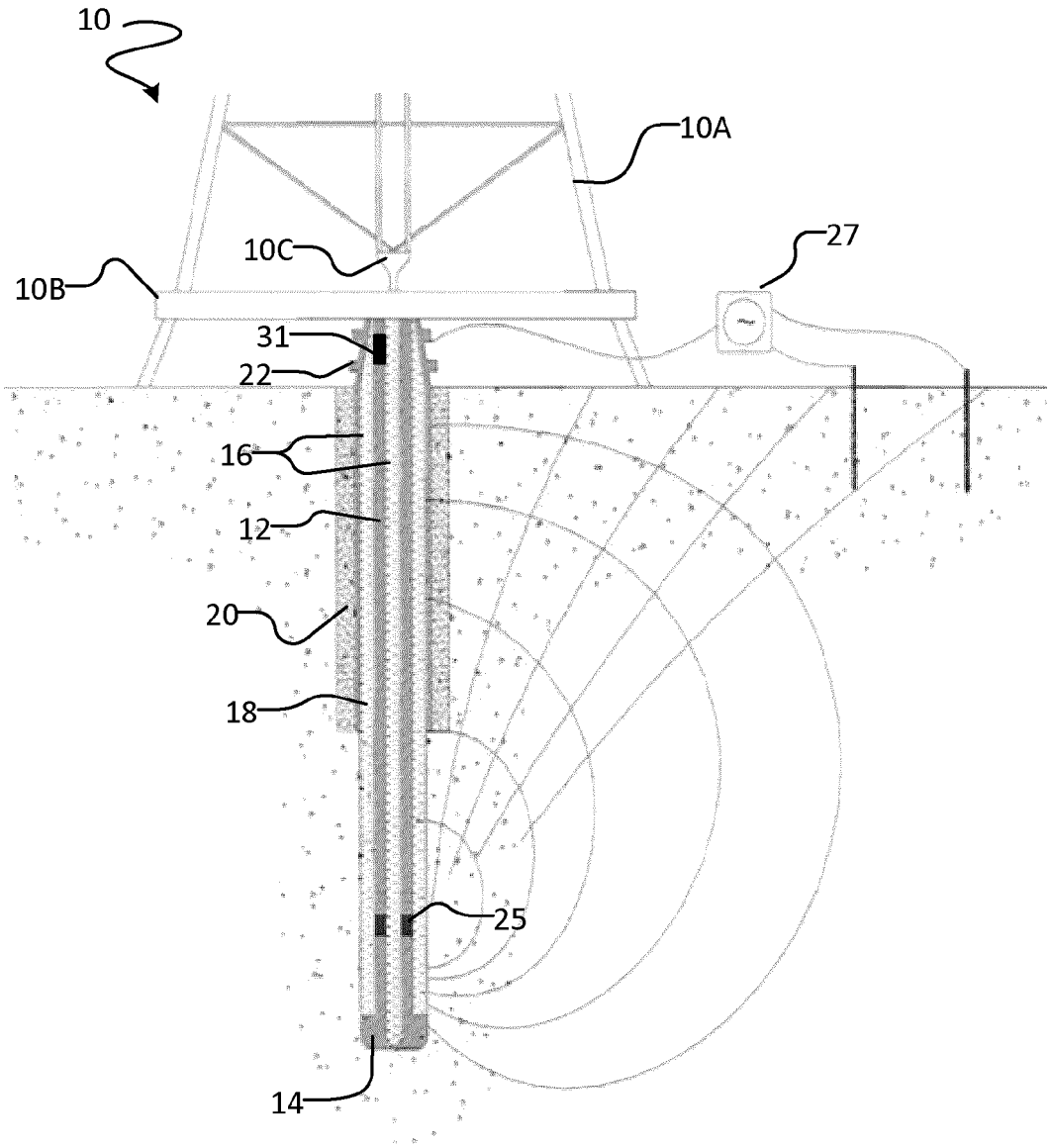
FIG. 1 is a schematic view of a drilling operation and telemetry system.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is filled with drilling fluid 16. Drilling fluid 16 is pumped through a bore in drill string 12 to drill bit 14 and returns to the surface through annular region 18 carrying cuttings from the drilling operation. As the well is drilled, a casing 20 may be made in the well bore. A blow out preventer 22 is supported at a top end of the casing.

Drill string 12 includes a bottom hole assembly 25. Bottom hole assembly 25 may include various components such as a probe, an electromagnetic telemetry signal generator, a mud hammer, and a mud pulse generator.

An electromagnetic telemetry signal generator (not shown) may generate electromagnetic signals that can be detected by a signal detector 27.

A mud pulse generator (not shown in FIG. 1) may generate pulses within drilling fluid 16 that can be detected by a pulse detector 31 (e.g. a pressure transducer). Pulse detector 31 may be mounted detect fluid pressure within drill string 12 at or near the surface (e.g. at a suitable above-ground location).

Figure 2:
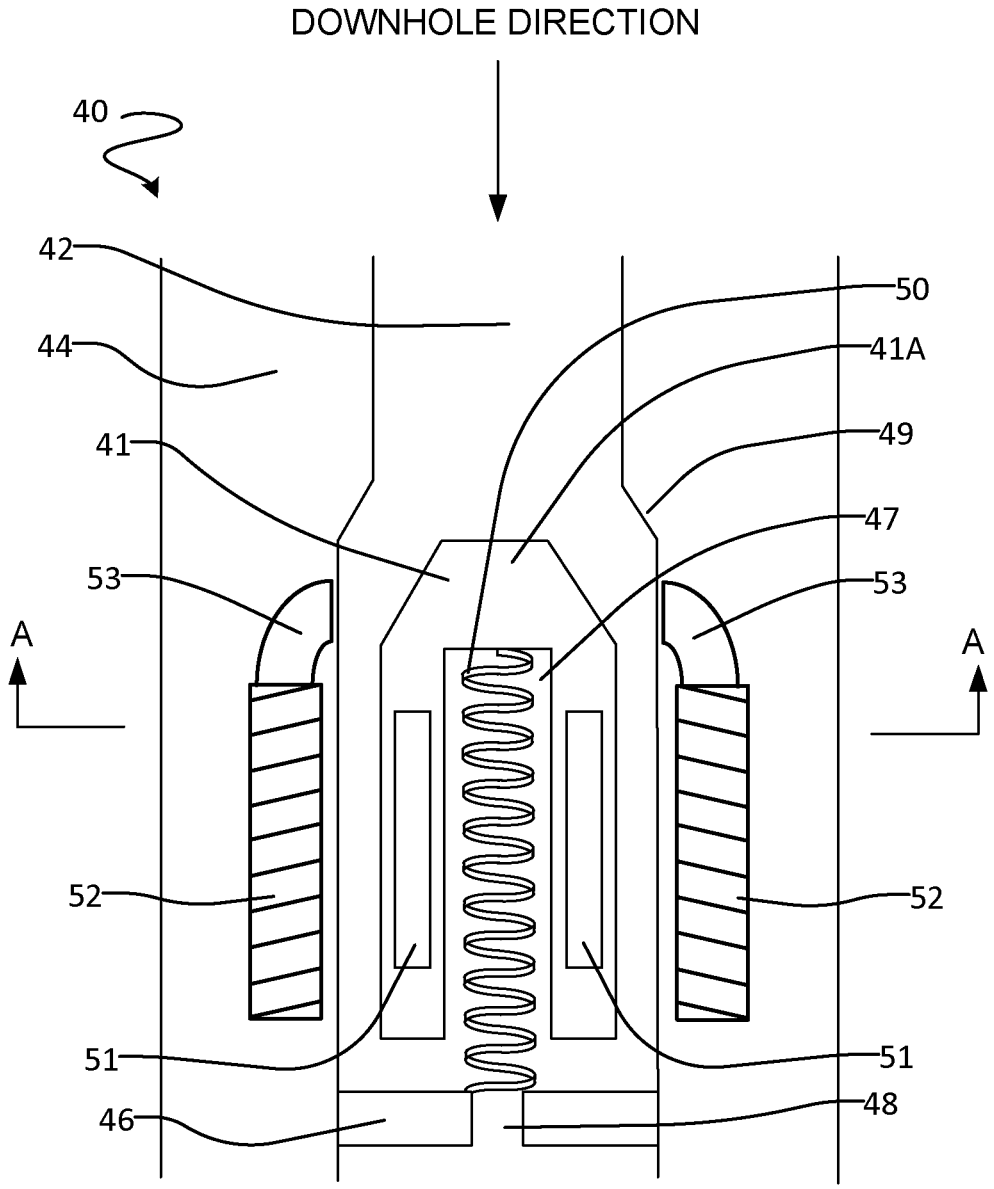
FIG. 2 is a cross sectional view of a mud hammer according to an example embodiment of the invention.

FIG. 2 is a cross sectional view of a mud hammer 40 according to an example embodiment. Mud hammer 40 may carry out two or more distinct functions. In some embodiments, it may carry out two or more distinct functions simultaneously. These functions may include:

- generating downhole pressure pulses which may be effective to increase penetration rate (e.g. by dislodging and clearing away drill cuttings from a drill bit);
- generating motion and vibration in the drill string which may be effective to prevent portions of the drill string from "sticking" to the walls of the borehole (e.g. via friction);
- generating uphole pressure pulses encoding data to be received by a detector at the surface; and generating electrical power which may be used by downhole electrical components.

As explained in more detail below, the energy for driving motion of mud hammer 40 may be provided primarily by the flow of drilling fluid. Modifying motion of the mud hammer to encode data and/or generating electrical power may involve electromagnetic interactions with the mud hammer.

In the illustrated embodiment, mud hammer 40 comprises a movable member which may be called a hammer 41. Hammer 41 is located within a bore 42 of a section of drill string 44.

A fluid port 48 is located adjacent to hammer 41. The restriction to the flow of fluid through port 48 is variable and depends on the position of hammer 41. In the illustrated embodiment, hammer 41 is movable axially. When hammer 41 is moved toward port 48 the flow of fluid through port 48 is more restricted. When hammer 41 is moved away from port 48 the flow of fluid through port 48 is less restricted.

In the illustrated embodiment, port 48 is supported on a shoulder 46 that projects inwardly from the interior walls of section 44. Shoulder 46 may be integrally formed with section 44, or it may be mounted to section 44 (e.g. by a press fit, by screw threading, etc.). Port 48 is provided by an aperture in shoulder 46. Shoulder 46 may be annular and aperture 48 may be circular, but in other embodiments these features can have other shapes.

Mud hammer 40 comprises a bias mechanism that biases hammer 41 into a position where the flow of fluid through port 48 is less restricted. The bias mechanism may, for example, comprise one or more springs, a reservoir containing a pressurized fluid, or the like. In some embodiments, other means are used to provide a force to bias hammer 41 to a configuration where flow through port 48 is less restricted. For example, in some embodiments, hammer 41 may comprise an integrally formed flexibly resilient member which biases hammer 41 away from shoulder 46. In some embodiments, one or more different types of springs in different arrangements may be used to provide a bias force, for example a coil spring, a Bellville spring, a compression spring, a tension spring, etc. In some embodiments, a compressed gas actuator such as a cylinder may be used in place of a spring. The compressed gas cylinder may contain a valve which can be operated to change the force exerted by the compressed gas cylinder on hammer 41.

In the illustrated embodiment, bias is provided by a spring. A cavity 47 extends into a central portion of hammer 41. A spring 50 extends from an end of cavity 47 to shoulder 46. Spring 50 biases hammer 41 away from shoulder 46. In some embodiments, spring 50 is mounted to one or both of hammer 41 and shoulder 46. In some embodiments, spring 50 maintains the alignment of hammer 41 within the center of bore 42.

Hammer 41 has an exterior diameter which is less than the interior diameter of section 44. Drilling fluid (not shown) flows in a downhole direction, passing hammer 41 through the annular region between hammer 41 and section 44. Drilling fluid then flows through port 48. The uphole end of hammer 41 may have a tapered portion 41A. Tapered portion 41A may reduce the turbulence of drilling fluid as it flows around hammer 41.

The downhole flow of drilling fluid generates a force which biases hammer 41 towards shoulder 46 against the force provided by spring 50. As described in more detail below, these opposing forces act to generate oscillations of hammer 41 in an axial direction. The frequency of these oscillations is a function of a variety of factors, including the shape and mass of hammer 41, the properties of spring 50, the flow rate of the drilling fluid passing by hammer 41 and the characteristics of the drilling fluid (e.g. density, viscosity etc.).

The oscillating motion of hammer 41 causes corresponding variations in the restriction to fluid flow through port 48. For example, hammer 41 may be oscillated vigorously enough to periodically strike shoulder 46, thereby momentarily sealing aperture 48 and preventing drilling fluid from flowing through aperture 48. Each time hammer 41 causes fluid flow to be significantly restricted the restriction results in a pressure pulse. In some embodiments, hammer 41 may not completely seal aperture 48 but rather significantly reduces the flow of drilling fluid through aperture 48. The periodic sealing (or near-sealing) of aperture 48 by hammer 41 generates pressure pulses in the drilling fluid. These pressure pulses propagate in both uphole and downhole directions.

One cycle of the movement of hammer 41 may occur as follows:

a) drilling fluid flows around hammer 41 and through aperture 48;
b) the drag of the flowing drilling fluid on hammer 41 provides force on hammer 41 in the downhole direction;
c) as hammer 41 moves downward and approaches shoulder 46, the space between hammer 41 and shoulder 46 decreases;
d) the velocity of the drilling fluid flowing through the diminishing space between hammer 41 and shoulder 46 increases;
e) the pressure of the drilling fluid in the space between hammer 41 and shoulder 46 decreases, thereby increasing the net downward force on hammer 41;
f) hammer 41 eventually contacts shoulder 46, substantially blocking the flow of drilling fluid through aperture 48 (and thereby reducing the downward force on hammer 41 while increasing the net upward force on hammer 41); and
g) spring 50 pushes hammer 41 back to its starting position in step a) (in some embodiments, electromagnetic forces may be applied to assist spring 50 in pushing hammer 41 back to its starting position—examples of this are provided below).

Each time hammer 41 contacts shoulder 46 or closely approaches shoulder 46 a downhole pulse is generated. The pulse travels downhole until it reaches drill bit 14. The downhole pulses may act to dislodge and clear away drill cuttings from drill bit 14. This may increase the drilling penetration rate. In drilling operations where lost circulation material is used, downhole pulses may enhance the effectiveness of the lost circulating material by driving it into the fissures through which drilling fluid is being lost.

The motion of hammer 41 and the generation of pulses may cause section 44 to move or vibrate. This motion or vibration may assist in reducing friction between section 44 and the sides of the borehole.

In some embodiments, mud hammer 40 may be configured such that hammer 41 contacts a constricted portion 49 of section 44. In the illustrated embodiment, constricted portion 49 is tapered and is dimensioned to be complementary to tapered portion 41A of hammer 41. In some embodiments, constricted portion 49 may comprise a shoulder element like shoulder 46. Spring 50 may push hammer 41 in an uphole direction until hammer 41 contacts or enters constricted portion 49 and thereby generates a pulse in the drilling fluid. Drilling fluid may then push hammer 41 in a downhole direction away from constricted portion 49.

In some embodiments, mud hammer 40 generates pulses by hammer 41 contacting only shoulder 46. In some embodiments mud hammer 40 generates pulses by hammer 41 contacting only constricted portion 49. In some embodiments, mud hammer 40 generates pulses by hammer 41 alternatively contacting shoulder 46 and constricted portion 49.

Mud hammer 40 comprises a mechanism for altering the pulses produced by the flow-driven oscillation of hammer 41 to encode data. In the illustrated embodiment, the mechanism is configured to apply electromagnetic forces to alter the motion of hammer 41. The electromagnetic forces may, for example, alter the motion of hammer 41 so as to change amplitudes of the pulses (e.g. by varying the degree of fluid flow restriction and/or the time that hammer 41 stays in a position of maximum flow restriction and/or the speed of the hammer just prior to the position of maximum flow restriction—the latter factor affects the rate at which fluid flow is throttled) and/or the frequency of the pulses (e.g. the frequency of pulses may be decreased by applying forces to hammer 41 that accelerate or retard the motion of hammer 41. For example, electromagnetic forces may be applied to hold hammer 41 in a position where flow is less restricted and/or in a position where flow is more restricted for longer periods than would otherwise occur and/or counteract other forces on hammer 41 so as to slow the motion of hammer 41; the frequency of pulses may be increased by applying forces to hammer 41 that tend to accelerate hammer 41 and/or to decrease the overall amplitude of oscillation of hammer 41).

In the illustrated embodiment, permanent magnets 51 are mounted within hammer 41. Electromagnets (e.g. comprising wire coils) 52 are mounted within the walls of section 44. The relative positions and orientations of magnets 51 and wire coils 52 are such than when a current is driven through wire coils 52, a magnetic field is generated that exerts a force on magnets 51, thereby modifying the axial movement of magnets 51 and hammer 41. In other embodiments (not shown), permanent magnets 51 and/or wire coils 52 are mounted within the walls of section 44 and one or more wire coils 52 are mounted within hammer 41.

In the embodiment illustrated in FIG. 2, magnets 51 are arranged in a circle surrounding cavity 47 of hammer 41 and wire coils 52 are arranged in a circle surrounding bore 42 of section 44. North and south poles of magnets 51 are longitudinally spaced apart from one another (e.g. magnets 51 may be oriented to be more or less parallel with the longitudinal axis of section 44). Each wire coil 52 is also arranged longitudinally. Wire coils 52 may have pole pieces 53 which are shaped to increase the magnetic field strength at the locations of magnets 51. In some embodiments, pole pieces 53 for one or more coils 52 extend inwardly relative to bore 42 (e.g. into shoulder 46 or restriction 49) so as to interact more strongly with magnetic fields of magnets 51.

The number, position, and orientation of magnets 51 and wire coils 52 can vary widely. In some embodiments, magnets 51 are integrally formed with hammer 41. In some embodiments, hammer 41 is itself made of a permanent magnet. In some embodiments, a plurality of magnets 51 or groups of magnets 51 are spaced apart longitudinally within hammer 41. In some embodiments, there is a single wire coil that encircles bore 42.

Figure 2A:
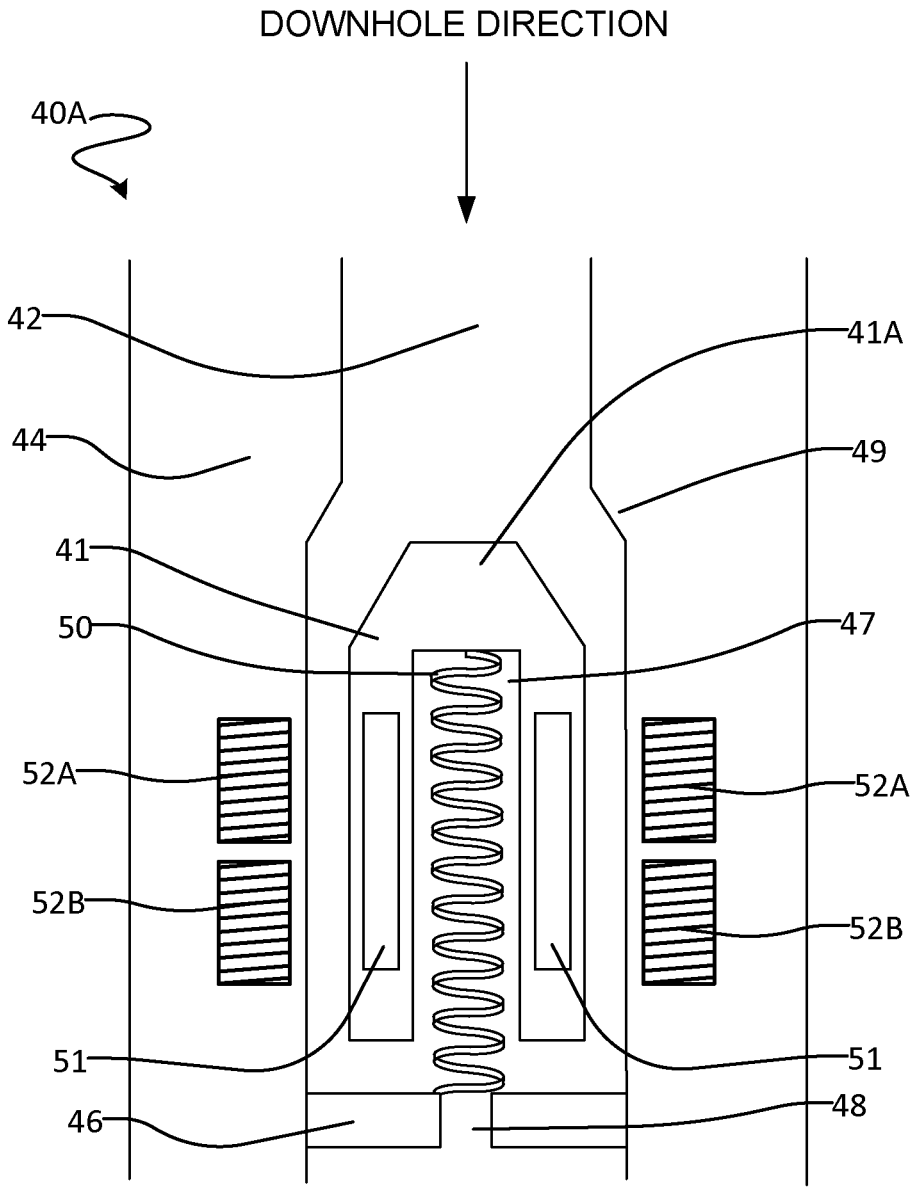
FIG. 2A is a cross sectional view of an alternative embodiment of the mud hammer shown in FIG. 2.

FIG. 2A shows a mud hammer 40A having an alternative configuration. Mud hammer 40A has a first set of wire coils 52A and a second set of wire coils 52B. The first and second sets of wire coils 52A and 52B are spaced apart longitudinally within section 44. Other embodiments provide more than two sets of longitudinally spaced apart coils.

Figure 3:
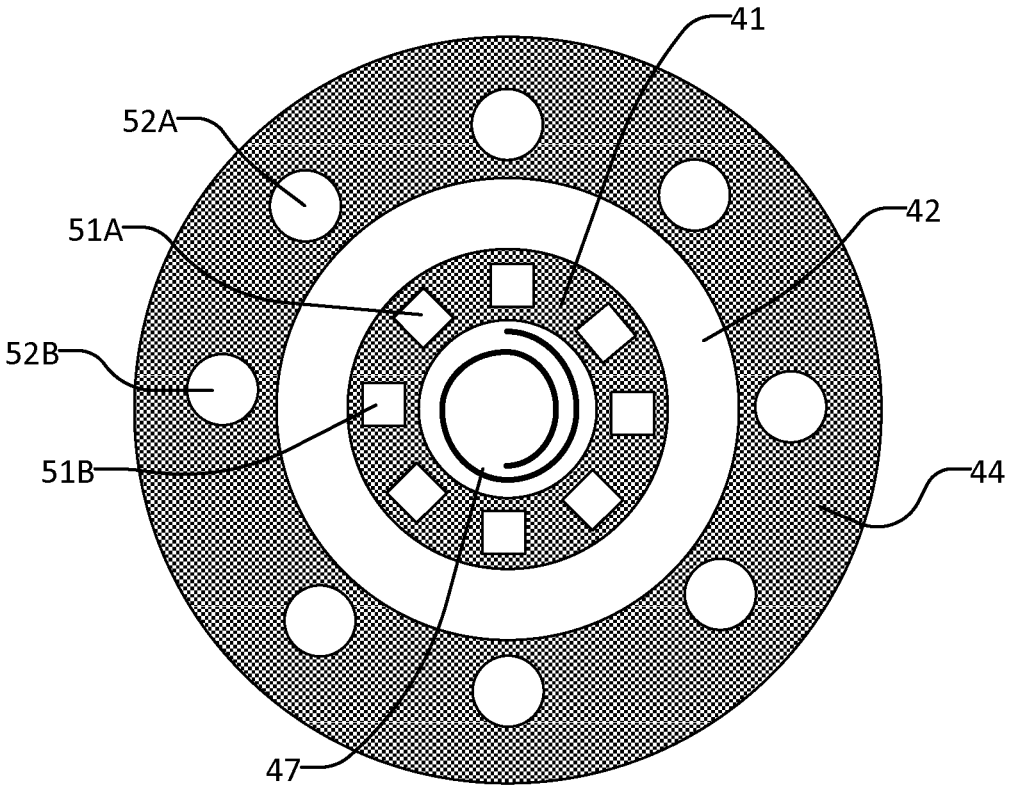
FIG. 3 is a cross sectional view along line A-A of the mud hammer shown in FIG. 2.

FIG. 3 is a cross sectional view along line A-A of the mud hammer in FIG. 2. Magnets 51 are arranged within hammer 41. Wire coils 52 are arranged within section 44.

In some embodiments, each of magnets 51 have their north poles pointing in the same direction. In such embodiments, the current through each of wire coils 52 may be driven in the same direction (i.e. clockwise or counter clockwise) to generate forces on all of magnets 51 in substantially the same direction.

In some embodiments, neighbouring magnets have opposite orientations such that the north pole of each magnet 51 is between the south poles of its neighbouring magnets 51. In such embodiments, the current through coils 52 may be driven in different directions in order to produce a force on each of magnets 51 in the same direction. For example, in FIG. 3, the north end of magnet 51A is visible and the south end of magnet 51B is visible. When current is driven through coil 52A in a clockwise direction, current may be driven through coil in 52B in a counter clockwise direction. This ensures that the forces exerted on magnets 51A and 51B are in the same direction at the same time. In such embodiments, an alignment feature may be provided to prevent hammer 41 from rotating relative to section 44, thereby maintaining the relative positions of magnets 51 and coils 52. One example of such an alignment feature is described below.

In some embodiments a controller is connected to cause current to flow in one or more coils such that the magnetic fields of the one or more coils resist motion of hammer 41. The controller may apply such fields to slow the motion of hammer 41 and/or to hold hammer 41 more-or-less still. In some embodiments, neighbouring magnets are configured to have opposite orientations. This configuration avoids strong repulsive forces between adjacent like poles, which may create stresses within hammer 41 that could lead to damage of hammer 41.

Figure 3A:
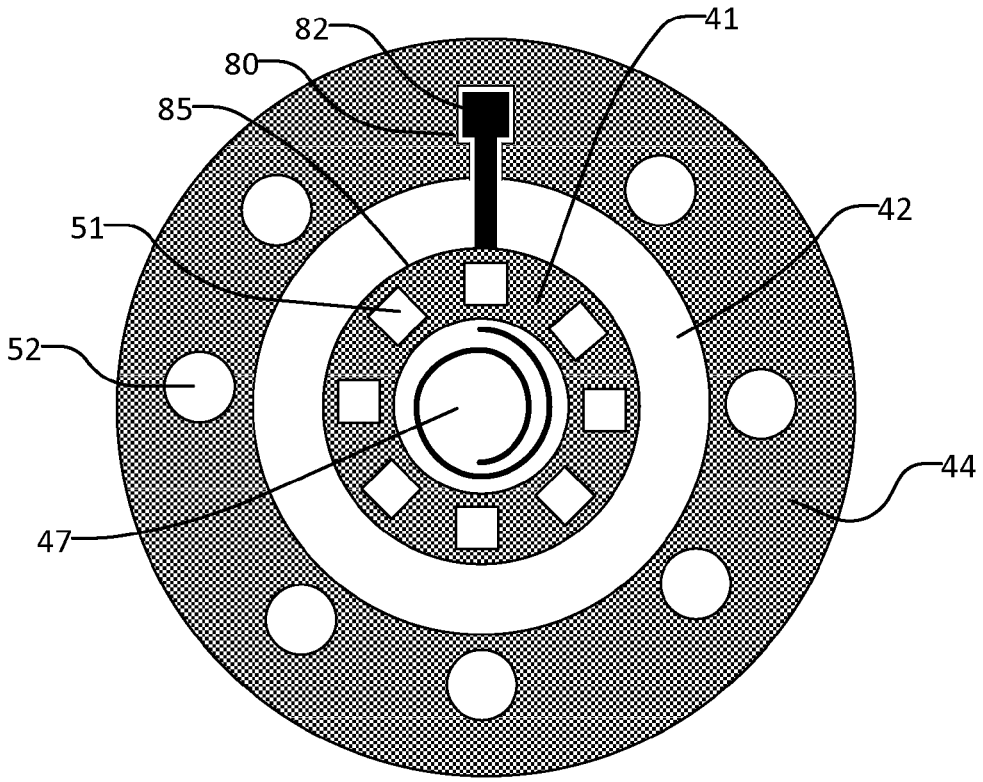
FIGS. 3A and 3B are alternative embodiments of the mud hammer shown in FIG. 3.
Figure 3B:
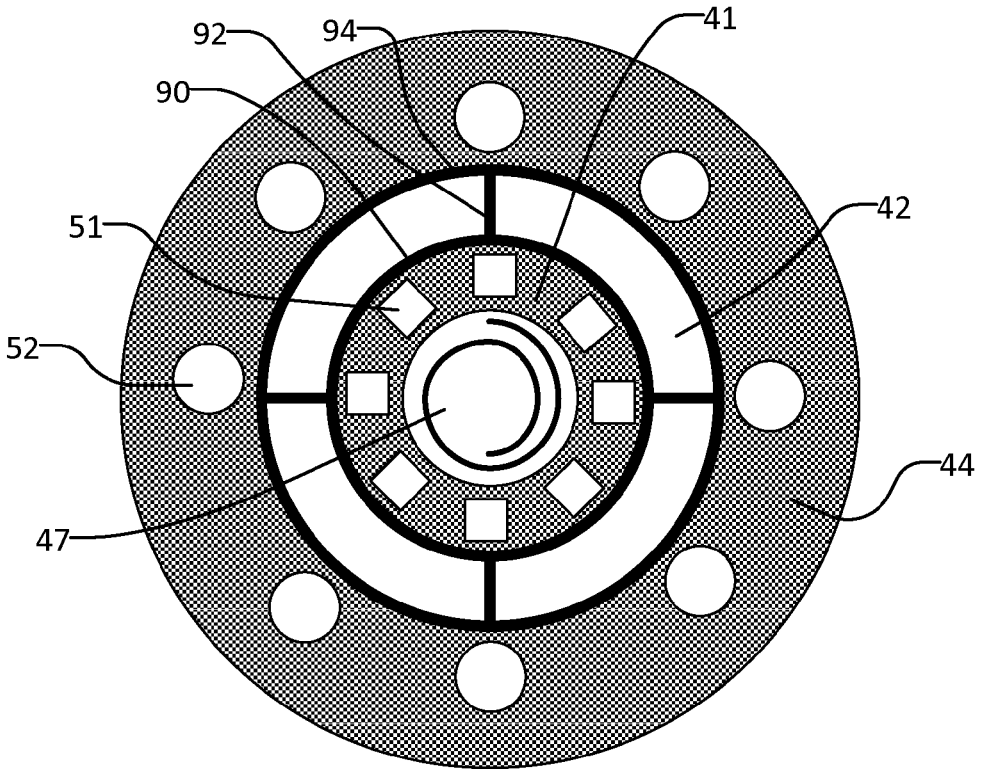

FIGS. 3A and 3B depict alternative embodiments of the mud hammer in FIG. 3.

In FIG. 3A, section 44 has an alignment feature 80. Keying feature 82 engages with alignment feature 80 at one end, and is mounted to hammer 41 at the other end. Alignment feature 80 and keying feature 82 are dimensioned such that keying feature 82 can move only axially within alignment feature 80. Hammer 41 is thereby prevented from rotating relative to section 44 and is maintained within the centre of bore 42 (i.e. the axis of hammer 41 is maintained in a substantially collinear relationship with the axis of section 44). Alignment feature 80 and/or keying feature 82 may be coated with a low friction coating.

In FIG. 3B, hammer 41 is surrounded by an inner ring 90. Inner ring 90 may be coupled to hammer 41 via a friction fit, a press fit, a threaded connection, or the like. Arms 92 are mounted to inner ring 90 at one end and to an outer ring 94 at the other end. Outer ring 94 is dimensioned to abut the inner wall of section 44. Outer ring 94 is not mounted to the inner wall of section 44, and is free to move axially within bore 42. Hammer 41 is thereby maintained within the center of bore 42. The outer surface of outer ring 94 and/or the inner wall of section 44 may be coated with a low friction coating. In other embodiments, other types of centralizing devices may be used. In some embodiments, hammer 41 may comprise fins or other projections which act to maintain hammer 41 centralized within bore 42.

In some embodiments, a current may be selectively driven through wire coils 52. This generates a magnetic field which exerts a force on magnets 51, thereby controlling the movement of hammer 41. The current may be driven in a direction such that the resulting forces act to either increase or decrease the speed of hammer 41 or to hold hammer 41 at a particular location.

In some embodiments, a load (e.g. a battery, a resistor, etc.) may be selectively applied to wire coils 52. In accordance with Lenz's law, the movement of magnets 51 induces a current in wire coils 52, which in turn generates a magnetic field which opposes the movement of magnets 51. The strength of the magnetic field depends in part on the impedance of the load. By varying the impedance of the load on wire coils 52, the movement of hammer 41 can be controlled.

In some embodiments, the movement of hammer 41 can be selectively modified by driving current through wire coils 52, applying a load to wire coils 52, or both.

By controlling the movement of hammer 41, the frequency with which hammer 41 restricts fluid flow through port 48 may be selectively controlled and/or the degree of flow restriction and/or the duration of the flow restrictions may be controlled. This allows control of the amplitude and/or frequency of drilling fluid pressure pulses. Data can be encoded by altering the frequency and/or amplitude of drilling fluid pressure pulses in a pattern corresponding to the data according to an encoding scheme. The pressure pulses may be received at the surface by a detector (e.g. a pressure transducer) and the pattern in the pressure pulses may be decoded to yield the data.

In some embodiments, hammer 41 has a "natural" frequency with which it strikes against shoulder 48 for given flow conditions in bore 42 when wire coils 52 are unpowered and unloaded. Wire coils 52 may be selectively powered and/or loaded to increase and/or decrease this frequency. Data may be transmitted as a pattern of pulses of varying frequencies.

Data transmission may be relatively fast. By operating at or close to the resonant frequency of hammer 41, pulses may be generated at high frequency. These pulses may be controlled as described herein to transmit data at relatively high data transfer rates. The amplitude of the pulses may be relatively small. A relatively sensitive detector may be provided at the surface to detect the pulses.

Data may be generated, transmitted, and detected as follows:

- a downhole sensor takes a measurement;
- the downhole sensor sends an electronic signal encoding data representing the measurement to a downhole control circuit;
- the downhole control circuit controls the application of forces to hammer 41 in a way that alters the fluid-driven motions of hammer 41 (e.g. by energizing electromagnets and/or connecting loads to coils) to produce a particular pattern of drilling fluid pulses encoding the measurement data;
- a detector at the surface detects the drilling fluid pulses; and
- a processor or other electronics component at the surface converts the pattern of drilling fluid pulses into an electronic signal encoding the measurement.

Figure 4:
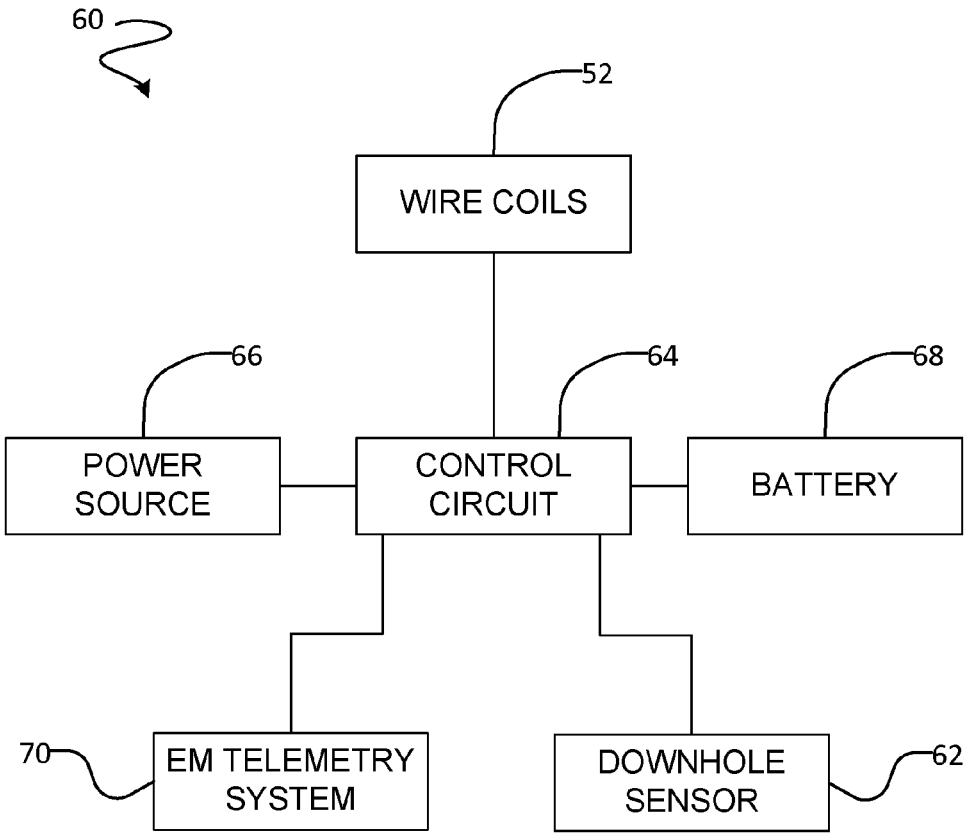
FIG. 4 is a schematic diagram of an electronics system associated with a mud hammer according to an embodiment of the invention.

FIG. 4 is a block diagram illustrating an example electronics system 60 associated with mud hammer 40. A downhole sensor 62 provides data, encoded in a signal, to a control circuit 64. Control circuit 64 processes the signal to determine a desired pattern of pressure pulses, and controls a power source 66 to drive a variable current through wire coils 52 which will cause hammer 41 to generate the desired pattern of pressure pulses. These pressure pulses may then be detected by pulse detector 31.

The movement of magnets 51 induces a current in one or more of coils 52. These induced currents may be used as a source of electrical energy. This electrical energy may, for example, be used to power electrical circuits and/or stored for later use in a battery, supercapacitor or other electrical power storage device. In some embodiments, the energy associated with this current is stored in a battery 68. Control circuit 64 may be configured to selectively allow a battery 68 to be charged by the current induced in one or more of wire coils 52. In some embodiments, power source 66 and battery 68 are the same element. In some embodiments, control circuit 64 is configured to allow battery 68 to power a downhole electronics component, such as an EM telemetry system 70 or downhole sensor 62 or electronic circuit 60.

Currents induced in one or more coils 52 and/or currents induced in one or more alternative magnetic field sensing coils and/or magnetic fields detected by one or more magnetic field sensors may be monitored to track the motions of hammer 41. A controller may apply information regarding the motions of hammer 41 to provide closed-loop control over motions of hammer 41 (by, for example, energizing coils 52 in a manner synchronized with the detected motions of hammer 41 to selectively retard or accelerate the motions of hammer 41 and/or loading one or more coils 52 in a manner synchronized with the detected motions of hammer 41 to selectively retard motions of hammer 41.

A battery charging circuit may be provided in conjunction with control circuit 64 to charge battery 68. The charging circuit may comprise one or more switches or rectifiers connected to rectify current induced in one or more coils 52.

Wire coils 52 may be electrically connected in many different ways. In some embodiments, wire coils 52 are connected in series. In some embodiments, wire coils are connected in parallel.

In some embodiments of the invention, wire coils 52 may not all be operated the same way. For example, some wire coils 52 may connected as electromagnets to alter motion of hammer 41 while other wire coils 52 are connected to act as electrical power generators.

In some embodiments, some of wire coils 52 are connected to power other wire coils 52. For example, in mud hammer 40A shown in FIG. 2A, first set of wire coils 52A may be connected so that electrical power generated in coils 52A may be selectively applied to power second set of wire coils 52B, thereby forming a self-generating shunt.

Multiple coils provide redundancy. If a single coil fails, the other coils may still be used. Furthermore, multiple coils may provide finer control of the motion of hammer 41. Different coils may be powered with different currents to achieve a desired net force on hammer 41. Different coils may be connected to different loads to provide variable damping of motion of hammer 41. For example, a controller may be used to individually connect shunt resistors across different coils.

In some embodiments control circuit 64 comprises a switching network that can be switched to selectively connect each of a plurality of coils in one or more different configurations. For example, control circuit 64 may operate the switching network to selectively connect a coil to: a power supply; a load or another coil. Control circuit 64 may be configured to permit these control inputs to be applied separately to each of a plurality of coils. In some embodiments the switching circuit is configured to allow control circuit 64 to selectively connect one of a plurality of loads across a coil. In some embodiments the power supply is variable such that current through the coil may be adjusted by control circuit 64. In some embodiments control circuit 64 is configured to control connection of each of a plurality of coils to a power supply. In some embodiments control circuit 64 is configured to independently set the polarity and/or current and/or voltage and/or power delivered by the power supply to each of a plurality of coils.

Figure 5:
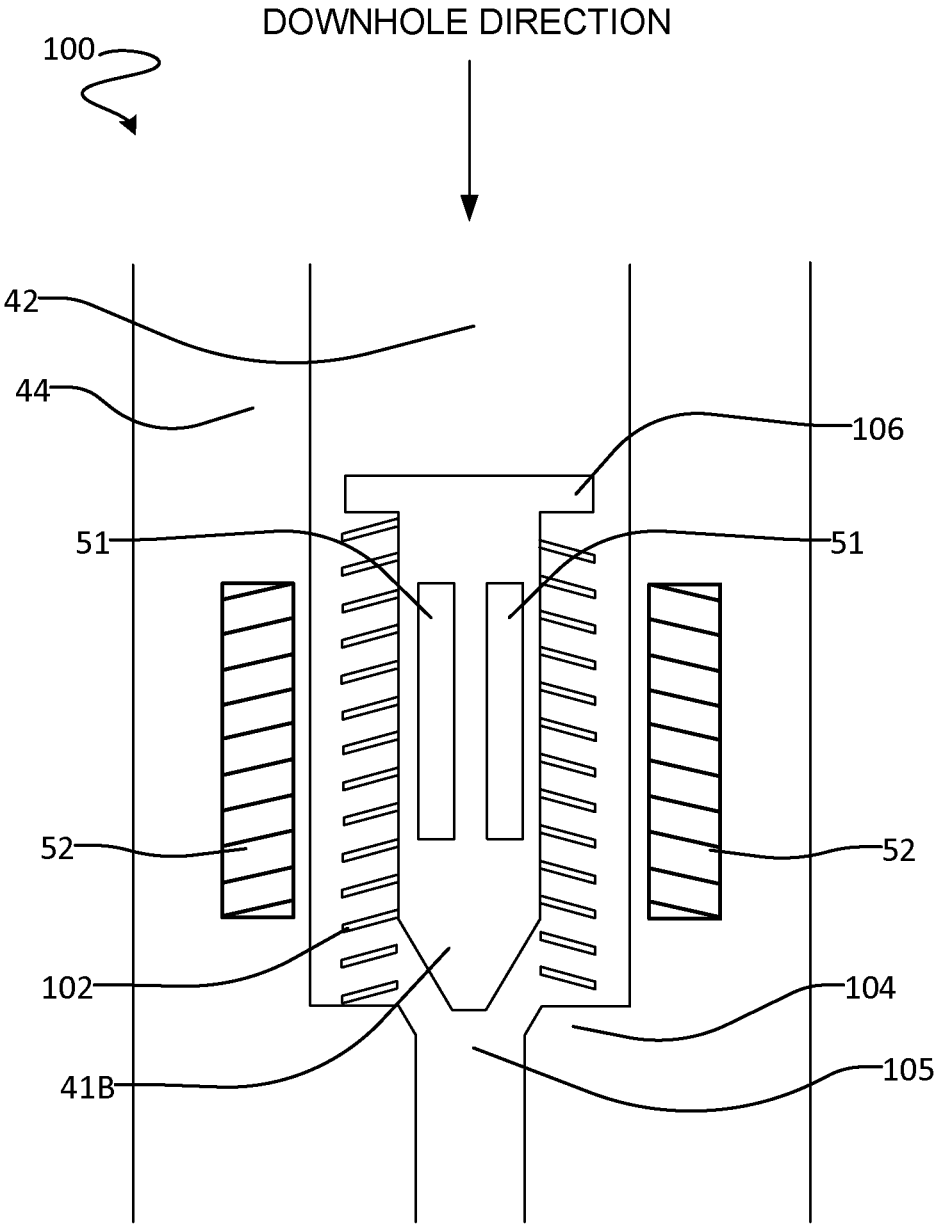
FIG. 5 is a cross sectional view of a mud hammer according to an embodiment of the invention.

FIG. 5 is a cross sectional view of a mud hammer 100 according to another embodiment. Like mud hammer 40, mud hammer 100 comprises a section 44, a bore 42, a plurality of coils 52, a hammer 41 and a plurality of magnets 51.

Hammer 41 is located within the centre of a spring 102. Spring 102 extends between a shoulder 104 and a flange 106. Shoulder 104 defines an aperture 105. In the illustrated embodiment shoulder 104 is integrally formed with section 44 and flange 106 is integrally formed with hammer 41, however it is not necessary that these features be integrally formed. Spring 102 provides a force which biases hammer 41 away from shoulder 104.

The downhole end of hammer 41 has a taper 41B. Taper 41B is dimensioned to abut a corresponding feature of shoulder 104. This may allow hammer 41 to more effectively seal aperture 105, thereby increasing the amplitude of the pressure pulses in the drilling fluid. Higher amplitude pressure pulses may be easier to detect at the surface and may also be useful for assisting with drilling, reducing friction between the drillstring and the wellbore etc.

Figure 6:
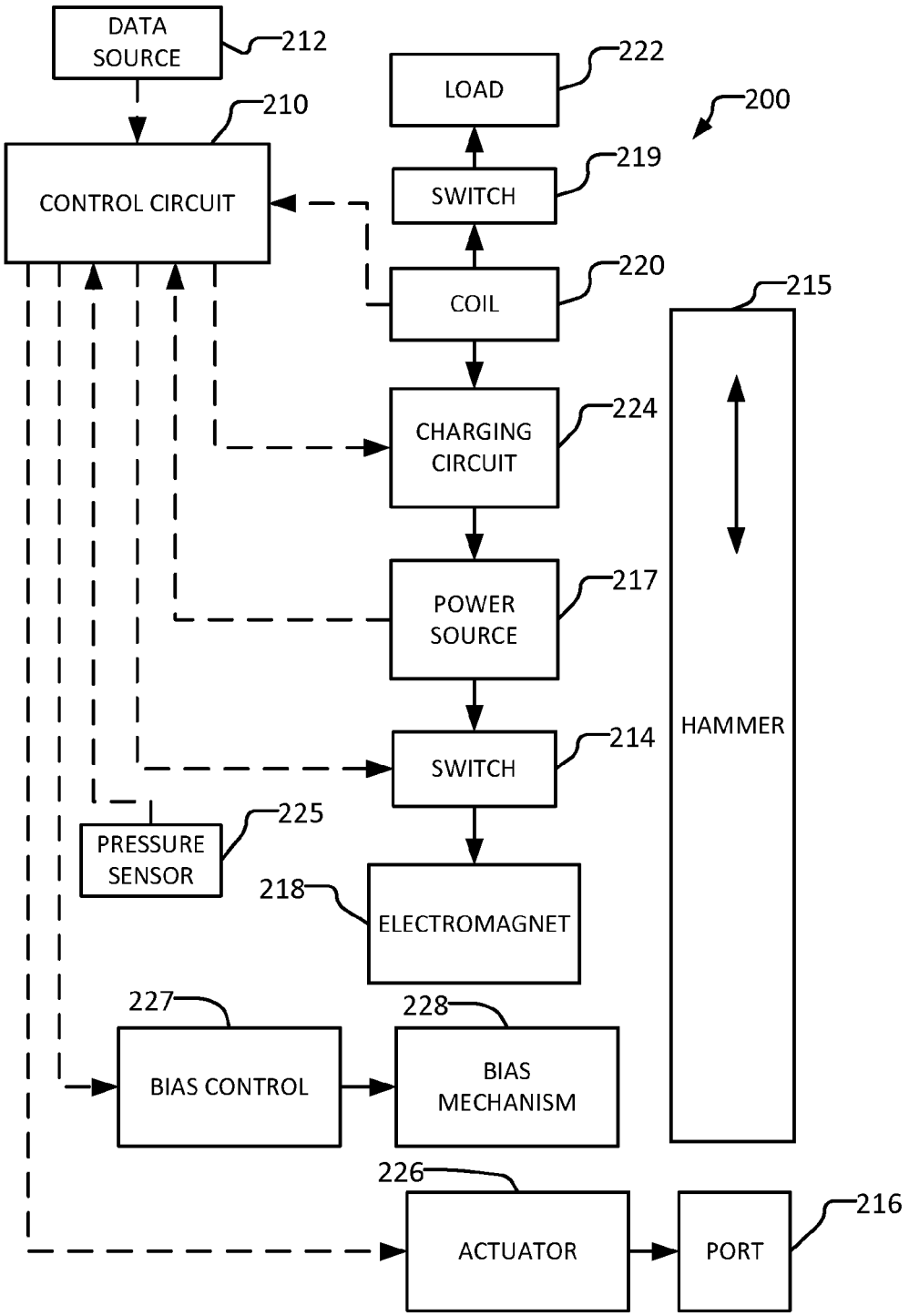
FIG. 6 is a block diagram illustrating a control system.

FIG. 6 shows schematically an example control system 200 for a mud hammer. The mud hammer could, for example, have a construction according to any embodiment as described herein. Control system 200 comprises a controller 210 which may, for example, comprise a programmed data processor (e.g. microprocessor, embedded processor, computer-on-a-chip, or the like), hard wired logic circuits, configurable logic devices or a combination thereof.

Controller 210 is connected to receive data to be transmitted from a data source 212. Data source 212 may, for example, comprise a system which acquires data from one or more sensors. Controller 210 is connected to vary pulses produced by a mud hammer 215 which is driven in oscillation and interacts with a fluid flow port 216 to create pulses.

In the illustrated embodiment, controller 210 exercises control over hammer 215 in one or more of several ways. One way that controller 210 can apply forces to hammer 215 is to operate a switch 214 that connects electrical power from a power source 217 (e.g. a battery) to an electromagnet 218. Switch 214 is not necessarily merely an on-off switch (although it could optionally be just that). In some embodiments, switch 214 comprises one or more switching components configured to permit controller 210 to reverse the polarity applied to electromagnet 218. For example, switch 214 may comprise an H bridge. In some embodiments, switch 214 comprises one or more electronic components configured to permit controller 210 to vary an electrical current in electromagnet 218.

Controller 210 can apply a force to hammer 215 by controlling the electrical current in electromagnet 218 by way of switch 214. In some embodiments one or both of the magnitude and direction of the force are controllable by controller 210.

Another way that controller 210 may optionally exercise control over hammer 215 is to operate a switch 219 that connects a coil 220 to a load 222. Coil 220 is located where the movement of magnets with hammer 215 can induce electrical currents in coil 220. Switch 219 is not necessarily an on/off switch. In some embodiments controller 210 can operate switch 219 to vary an electrical impedance presented to coil 220. Coil 220 may be separate from electromagnet 218, as shown. However, in some alternative embodiments electromagnet 218 also provides coil 220.

Another way that controller 210 may optionally exercise control over hammer 215 is to open or close or adjust one or more valves that alter the flow of fluid past hammer 215. Such valves may, for example, control the amount of fluid allowed to flow through a channel that bypasses hammer 215.

Another way that controller 210 may optionally exercise control over hammer 215 is to alter a mechanical component that affects the motion of hammer 215. The mechanical component may comprise, for example, a stop that limits travel of hammer 215 in one direction that can be moved to alter the travel of hammer 215 or an accumulator or other reservoir that supplies pressure for the damping of motion of hammer 215 or the control of fluid flow past hammer 215. Pressure in such an accumulator or reservoir may, for example, be set by selectively opening and closing valves to place the accumulator or reservoir in fluid communication with bore 42 or the annulus surrounding the drill string.

Controller 210 may use any one or more of the ways described above to control motion of hammer 215. Different embodiments may include provision for controller 210 to use different ones of the above ways or to use different combinations of two or more of the above ways to control motion of hammer 215.

Control system 200 also includes a charger circuit 224 connected to charge power source 217 using electrical power generated in coil 220. Another way that controller can exercise control over hammer 215 is to control the current drawn by charger circuit 224 from coil 220.

Controller 210 may be configured to alter the frequency and/or amplitudes of pulses being generated by the interaction of hammer 215 and fluid port 216 by applying forces to hammer 215 during selected parts of its oscillating cycle. Controller 210 may monitor the current position and/or speed of hammer 215 or may otherwise follow the cycle of hammer 215 so as to apply forces at the appropriate times to effect the desired changes in pulse frequency and/or amplitude.

In the illustrated embodiment, controller 210 monitors the output of coil 220 (or another sensing coil). Controller 210 can determine the direction of motion and velocity of hammer 215 from the polarity and amplitude of the voltage (or current) induced in coil 220. In addition or in the alternative, controller 210 monitors a pressure sensor 225. Pressure sensor 225 may detect pulses generated by hammer 215 and, from the period of the pulses, estimate where hammer 215 is in its oscillating cycle. For example, hammer 215 may be expected to be at its position farthest from port 216 approximately half-way between adjacent pulses.

Controller 210 may encode data in pulses from hammer 215 by changing its operation so that pulses are generated in two or more distinguishable patterns. Each pattern may be achieved by applying selected forces to hammer 215 at one or more points in its cycle (one pattern may involve no additional forces being applied to hammer 215). The patterns may be specified in software and/or the configuration of controller 210. In a non-limiting trivial example embodiment, controller 210 may be configured to transmit binary data by applying forces to hammer 210 that reduce a frequency of generated pulses (e.g. by pulling hammer 215 away from port 216 at least when hammer 215 is in the part of its cycle when it is farthest from port 216 and/or by applying forces that generally retard the motion of hammer 215) when it is desired to transmit a binary "0" and by not interfering with the motion of hammer 215 when it is desired to transmit a binary "1" or vice versa.

Power to drive controller 210 may be derived from power source 217, which may be recharged by charging circuit 224.

Some embodiments provide one or more additional or alternative mechanisms by which controller 210 can alter the frequency and/or amplitude of pulses produced by hammer 215. For example, the amplitude of produced pulses will depend in part on how much hammer 215 restricts fluid flow through port 216. In some embodiments port 216 comprises an adjustable seat or stop controlled by an actuator. Controller 210 may operate the actuator to adjust the seat or stop to alter the degree to which fluid flow is restricted when hammer 215 is located to apply the most restriction to fluid flow through port 216. In some embodiments, hammer 215 is biased away from port 216 by a hydraulic mechanism that is adjustable (for example, by opening, closing or otherwise adjusting a valve). Controller 210 may be connected to drive an actuator to open, close or otherwise adjust the valve.

FIG. 6 shows controller 210 being connected to control port 216 by way of an actuator 226 and to control a bias mechanism 228 by way of a bias control 227.

For clarity of explanation, FIG. 6 shows only one electromagnet 218 and one coil 220. A mud hammer system as described herein may have two or more electromagnets and/or two or more coils 220. In such embodiments, a control system like that shown in FIG. 6 may have switches connected to permit the controller to control each of the electromagnets and/or each of the coils.

Figure 7:
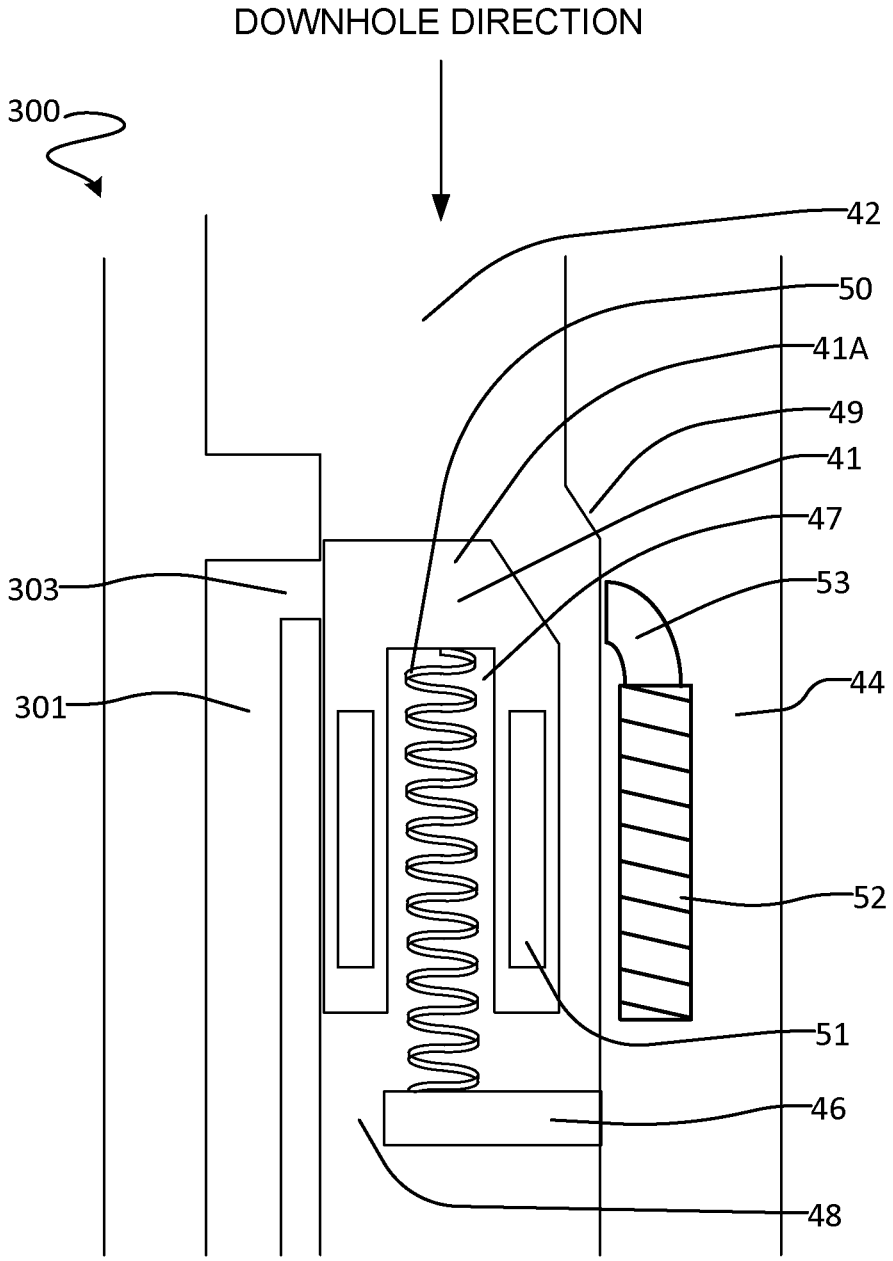
FIG. 7 is a cross sectional view of a mud hammer according to an alternative example embodiment of the invention.

FIG. 7 shows an example mud hammer 300 according to an alternative example embodiment. Mud hammer 300 shares many of the same features as mud hammer 40. These features have been assigned the same reference numbers as in FIG. 2.

Mud hammer 300 includes a channel 301 formed in the wall of section 44. Channel 301 has an opening 303. Drilling fluid may flow through opening 303 into channel 301. Channel 301 may rejoin bore 42 of section 44 at some point downhole of mud hammer 300

As hammer 41 moves within bore 42 of section 44, it alternatively covers and uncovers opening 303, thereby alternatively preventing and allowing drilling fluid to flow through channel 301. The covering and uncovering of opening 303 generates pulses in the drilling fluid. These pulses may be in addition to the pulses generated by hammer 41 contacting shoulder 46 and/or constricted portion 49.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back"," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A mud pulse telemetry method comprising:

operating a downhole pulser in a drill string to generate pressure pulses by flowing drilling fluid through the drill string, the flowing drilling fluid causing oscillating motion of a movable member of the pulser, the movable member comprising a hammer for generating drilling fluid pulses within a bore of the drill string;

altering motion of the movable member by applying electromagnetic forces to the movable member to alter one or both of the intensity and timing of the pressure pulses according to telemetry data.

2. A method according to claim 1 wherein altering motion of the movable member comprises allowing a magnetic field from one or magnets in the movable member to induce electrical currents in a plurality of coils and varying a load applied to each of the plurality of coils.

3. A method according to claim 2 wherein the coils are spaced apart longitudinally and extend around the movable member the movable member moves along an axis concentric with the coils.

4. A method according to claim 3 wherein the one or more magnets comprise a plurality of magnets angularly spaced apart around the movable member.

5. A method according to claim 4 wherein the plurality of magnets are aligned parallel to the axis.

6. A method according to claim 2 wherein the one or more magnets comprise a plurality of magnets angularly spaced apart around the movable member and the plurality of coils are angularly spaced apart around an axis along which the movable member moves.

7. A method according to claim 6 wherein for each of the plurality of magnets there is a corresponding one of the plurality of coils.

8. A method according to claim 7 wherein the plurality of magnets alternate in polarity.

9. A method according to claim 8 wherein controlling the motion of the movable member comprises driving electrical currents through the coils of the plurality of coils.

10. A method according to claim 9 comprising selecting polarities of the currents such that magnetic fields produced by the coils of the plurality of coils alternate in orientation.

11. A method according to claim 2 comprising applying electrical currents induced in the coils to charge a battery.

12. A method according to claim 1 comprising detecting the pressure pulses at a location removed from the downhole pulser and extracting the telemetry data from the detected pressure pulses.

13. A method according to claim 12 wherein the location removed from the downhole pulser is a location where the drill string emerges from a surface of the earth.

14. A method according to claim 1 wherein the movable member is located in a bore of a drill collar and applying electromagnetic forces to the movable member comprises passing electrical current through one or more electromagnets in a wall of the drill collar.

15. A method according to claim 1 wherein altering the motion of the movable member comprises altering a frequency of oscillation of the movable member.

16. A method according to claim 1 comprising tracking one or both of a position of the movable member and a velocity of the movable member and timing application of the electromagnetic forces to the movable member based on one or both of the tracked position and the tracked velocity of the movable member.

17. A method according to claim 16 wherein the position or the velocity of the moveable member is tracked based on a pressure measurement of downhole drilling fluid.

18. A method according to claim 16 further comprising applying the motion of the moveable member to generate electrical power, and wherein the position or the velocity of the moveable member is tracked based on either the current or the voltage of the generated electrical power.

19. A method according to claim 1 further comprising applying the motion of the movable member to generate electrical power.

20. A method according to claim 19 wherein altering the motion of the movable member comprises timing the generation of electrical power.

21. A method according to claim 19 wherein generating electrical power comprises allowing a magnetic field from one or more magnets carried by the movable member to induce an electrical current in a coil located adjacent to the movable member.

22. A method according to claim 1 comprising applying the generated electrical power to charge a battery.

23. A method according to claim 19 comprising applying the generated electrical power to drive altering motion of the movable member.

24. A method for operating a mud hammer, the method comprising:

providing a hammer for generating drilling fluid pulses within a bore of a drill string, at least one magnet coupled to the hammer, an electromagnet located to generate a variable magnetic field at the magnet and a power source connected to drive the electromagnet;

driving motion of the hammer under the combined influence of a flow of drilling fluid through the bore and the variable magnetic field and controlling the variable magnetic field to alter the motion of the hammer to generate pulses in the drilling fluid, the pulses encoding data.

25. A method according to claim 24 wherein the data is encoded in the frequency of the pulses.

26. A method according to claim 24 wherein the data is encoded in the amplitude of the pulses.

27. A mud hammer comprising:

a hammer movable relative to a fluid port in a bore of a drill string section to generate drilling fluid pulses within the bore;

a magnet;

a coil located near the magnet;

a power source connected to energize the coil to generate a variable magnetic field at the magnet;

wherein:

one of the magnet and the coil is coupled to the hammer; and the power source comprises a control circuit configured to receive a signal encoding data; and the control circuit is configured to control the variable current through the coil to alter motion of the hammer to generate drilling fluid pulses encoding the data.

28. A mud hammer according to claim 27 wherein the magnet comprises a plurality of magnets angularly spaced apart around the hammer.

29. A mud hammer according to claim 28 wherein neighbouring ones of the magnets are opposite in polarity.

30. A mud hammer according to claim 29 wherein the coil comprises one of a plurality of coils that are angularly spaced apart around an axis along which the hammer is movable.

31. A mud hammer according to claim 30 wherein for each of the plurality of magnets there is a corresponding one of the plurality of coils.

32. A mud hammer according to claim 31 comprising a power supply controllable to drive electric currents through the coils, the power supply connected so as to cause magnetic fields of adjacent ones of the coils to have opposite polarities.

33. A mud hammer according to claim 30 comprising a control circuit configured to selectively connect each of the plurality of coils to an electrical load.

34. A mud hammer according to claim 27 comprising a polarity reversing switch coupled between the power source and the coil.

35. A mud hammer according to claim 34 wherein the polarity-reversing switch comprises an H-bridge circuit.

36. A mud hammer according to claim 1 comprising a switching network configured to selectively connect the coil to the power supply, a load or another coil.

37. A mud hammer according to claim 36 wherein the switching network is configured to selectively connect the coil to one of a plurality of loads.

38. A mud hammer according to claim 27 wherein the coil is coupled to the hammer.

39. A mud hammer according to claim 27 wherein the magnet is coupled to the hammer.

40. A mud hammer according to claim 29 wherein the coil is mounted within a wall of the section of drill string.

41. A mud hammer according to claim 39 wherein the coil comprises a wire coil extending around the circumference of the bore.

42. A mud hammer according to claim 27 wherein the coil is coupled to provide electrical power to an electronic component.

43. A mud hammer according to claim 42 wherein the electronic component comprises a battery.

44. A mud hammer according to claim 42 where in the electronic component comprises an electromagnetic telemetry system.

45. A mud hammer according to claim 27 comprising a shoulder located to restrict movement of the hammer in a downhole direction.

46. A mud hammer according to claim 27 comprising a shoulder located to restrict movement of the hammer in an uphole direction.

47. A mud hammer according to claim 45 wherein the shoulder is mounted to the section of drill string.

48. A mud hammer according to claim 45 wherein the shoulder defines the fluid port.

49. A mud hammer according to claim 27 comprising a biasing means configured to bias the hammer toward a position in which the fluid port is less restricted.

50. A mud hammer according to claim 27 comprising a biasing means configured to bias the hammer toward a position in which the fluid port is more restricted.

51. A mud hammer according to claim 49 wherein the hammer defines a cavity, and wherein the biasing means is located in the cavity.

52. A mud hammer according to claim 27 wherein the hammer is cylindrical and the axis of the hammer is substantially collinear with the axis of the section of drill collar.

53. A mud hammer according to claim 52 wherein:

the hammer comprises a keying feature that engages a corresponding alignment feature in the section of drill collar;

the keying feature maintains the axis of the hammer in a substantially collinear relationship with the axis of the section of drill collar; and the keying feature prevents the rotation of the hammer relative to the section of drill collar.

54. A mud hammer according to claim 52 wherein:

the hammer comprises a plurality of projections;

the projections extend away from the hammer and abut an inner surface of the bore; and the projections maintain the axis of the hammer in a substantially collinear relationship with the axis of the bore.

55. A mud hammer according to claim 52 wherein an uphole end of the hammer is tapered.

* * * * *